United States Patent [19]

Schweitzer et al.

[11] 4,269,728

[45] May 26, 1981

[54] METHOD FOR STORING SPENT NUCLEAR FUEL IN REPOSITORIES

[75] Inventors: Donald G. Schweitzer, Bayport; Cesar Sastre, Shoreham; Warren Winsche, Bellport, all of N.Y.

[73] Assignee: The United States of America as represented by the United States Department of Energy, Washington, D.C.

[21] Appl. No.: 68,359

[22] Filed: Aug. 21, 1979

[51] Int. Cl.[3] ..... G21F 9/34

[52] U.S. Cl. ..... 252/301.1 W; 250/506; 264/0.5

[58] Field of Search ..... 252/301.1 W; 264/0.5; 250/506, 507

[56] References Cited

U.S. PATENT DOCUMENTS

| | | | |
|---|---|---|---|
| 3,046,403 | 7/1962 | Montgomery | 252/301.1 W |
| 3,152,984 | 10/1964 | Winsche et al. | 252/301.1 W |

FOREIGN PATENT DOCUMENTS

| | | | |
|---|---|---|---|
| 2551349 | 5/1977 | Fed. Rep. of Germany . | |
| 2801946 | 7/1979 | Fed. Rep. of Germany | 250/506 |

OTHER PUBLICATIONS

Sawle, D. R., "Sulfur-cooled power reactor study," Chem. Abstracts, vol. 55, (1961) #24285g.

*Primary Examiner*—Deborah L. Kyle

*Attorney, Agent, or Firm*—Cornell D. Cornish; Leonard Belkin; James E. Denny

[57] ABSTRACT

A method for storing radioactive spent fuel in repositories containing sulfur as the storage medium is disclosed. Sulfur is non-corrosive and not subject to radiation damage. Thus, storage periods of up to 100 years are possible.

5 Claims, No Drawings

METHOD FOR STORING SPENT NUCLEAR FUEL IN REPOSITORIES

BACKGROUND OF THE INVENTION

The invention described herein was made or conceived in the course of, or under a contract with, the United States Department of Energy.

FIELD OF THE INVENTION

This invention relates to the storage of spent fuel in repositories in which sulfur is used as the storage medium. More particularly, the invention relates to an improvement in the method for the storage of radioactive wastes in repositories in which the storage medium is liquid sulfur and the repositories are made self-sealing.

DESCRIPTION OF THE PRIOR ART

In view of the fact that nuclear energy will be increasingly used to supply the world's energy, the nuclear industry is faced with the problem of developing a method for safely disposing of radioactive wastes. It must especially be ensured that the radioactivity from such wastes will not contaminate the environment.

Up until a short time ago, storage facilities were expected to hold spent fuel for less than 10 years. However, new policy guidelines require that the fuel may have to be stored for periods of up to 100 years.

A number of factors must be taken into consideration in the development of a method for safely storing radioactive wastes for this length of time. For example, the question of storage cost must be considered. In this connection, it will be appreciated that it is always possible to arrange a large number of so-called barriers around the radioactive wastes to be stored. On the other hand, a large number of such barriers will significantly increase the storage costs and, in turn, make the production of nuclear energy less competitive when compared to other sources of energy.

The most common storage medium for spent fuel elements has been water. However, water presents problems in that over long periods of time, e.g., up to ten years, it exerts a corrosive effect on the containers and parts of the repositories in contact with the water. This ultimately results in various metallic salts from the repositories and the elements being dissolved in the water. Such salts do possess a level of radioactivity.

Consequently, should an accident occur wherein a leak results, the water with the radioactive salts dissolved therein can leak out and is easily absorbed into the ground or evaporates into the atmosphere leaving the radioactive contaminants. Thus, water is not suitable for a long term storage medium.

In the past, a variety of methods for storing radioactive materials have been utilized.

In U.S. Pat. No. 4,131,564, a process for preparing solid wastes containing radioactive or toxic substances for safe handling, transportation and permanent storage has been described. A similar method is disclosed in U.S. Pat. No. 3,838,061.

U.S. Pat. No. 3,824,673 discloses a method for the treatment of irradiated fuel elements, particularly for transporting the fuel elements wherein a molten alloy material is deposited between the fuel rods and the alloy is allowed to solidify.

The concept of making containers self-sealing for long-term storage is described in U.S. Pat. No. 3,983,050. In this case, the radioactive material is stored in a container in which powdered cement is added so that any leak will cause hardening of the cement when the storage container is in a moisture-containing environment, such as, open air or a water tank storage.

SUMMARY OF THE INVENTION

Applicants have discovered that long-term storage requirements which are now considered to be necessary can be met by utilizing, as the storage medium, elemental sulfur. The use of the sulfur avoids the disadvantages of the water previously used and further provides extremely long term storage capability, e.g., up to and even more than 100 years.

DETAILED DESCRIPTION OF THE INVENTION

The repositories used in accordance with the invention may be of conventional design. For example, tanks or other suitable containers to be used for the storage of nuclear waste, conventionally have diameters of from 6 to 18 feet. In most cases, containers with diameters of 15 or 16 feet are used.

The spent radioactive fuel elements from nuclear reactors are introduced into the above-described repositories. Subsequently, these fuel elements are in their entirety surrounded by sulfur. Sulfur has the advantage that it is non-corrosive and is not subject to radiation damage. As a result, sulfur is an extremely stable material under radioactive conditions.

Since the sulfur is non-corrosive, it does not effect dissolution of the metallic parts of the fuel elements or the repositories. Thus, the sulfur itself does not represent a radiation hazard. Moreover, of course, in the event of a leak, the sulfur is not absorbed either into the ground or the atmosphere and since it does not contain radioactive salts in any event, the danger of a radioactive contamination is minimized.

In a preferred embodiment according to the present invention, the sulfur in which the fuel elements are stored is continuously kept at a temperature of more than about 112° C. to maintain the sulfur in the liquid state. Accordingly, should a leak occur, the sulfur will immediately solidify at the leakage point where it is exposed to ambient temperatures below 112° C. As a result, it is ensured that the liquid sulfur will not escape from the container and the radioactive fuel elements are not exposed to the atmosphere.

In accordance with another feature of the present invention, the decay heat given off by the spent fuel is utilized to maintain the temperature of the sulfur at a level above the melting point of the sulfur. For this purpose, the fuel elements are spaced within the repository in which they are stored sufficiently close so that the temperature in the sulfur which surrounds the fuel elements is kept at a level of at least 112° C. throughout the repository and the sulfur is constantly maintained in the molten state.

The method of the present invention may be implemented in a variety of ways. Generally, the spent fuel elements can be introduced into a cylinder which is usually made of metal. The sulfur is then added to the cylinder in either the molten or solid particulate form so as to completely surround the fuel elements. If the sulfur is in the form of a solid particulate, the cylinder may be heated to make the sulfur molten. Thereafter, it may be necessary to add additional particulate sulfur in order to make certain that the elements are totally immersed.

Also, it may be desirable to continue the heating of the molten sulfur for a period of time sufficient to make certain that there are no air bubbles entrapped in the molten sulfur. Thereafter, the molten sulfur can be allowed to solidify about the elements. As noted hereinabove, depending on the placement of the elements, when the individual cylinders containing the elements are placed into the final repository, they may be spaced at an appropriate distance so that any decay heat given off by the elements may be sufficient to keep the sulfur in the molten state.

We claim:

1. In a method for storing spent fuel elements from nuclear reactors wherein the elements are immersed in a storage medium in a repository, the improvement which comprises said medium being elemental sulfur.

2. The method of claim 1 wherein the temperature of the sulfur is maintained above its melting point.

3. The method of claim 2 wherein the fuel elements are spaced at intervals within the surrounding sulfur so that the decay heat of the fuel elements maintains the sulfur at a temperature above its melting point.

4. The method of claim 1 wherein the elements are immersed in the sulfur by first surrounding the elements with sulfur in a particulate solid form, and then the sulfur is heated to render it molten and to remove bubbles and voids therefrom and wherein thereafter the molten sulfur is allowed to cool and solidify.

5. The method of claim 1 wherein the elements are immersed by surrounding them with sulfur in the molten state and wherein thereafter the sulfur is allowed to solidify.

* * * * *